United States Patent [19]

Weber

[11] Patent Number: 4,898,428

[45] Date of Patent: Feb. 6, 1990

[54] POWER SUPPLY SYSTEM FOR AN UNDERGROUND MINING MACHINE

[75] Inventor: Karl-Heinz Weber, Witten-Heven, Fed. Rep. of Germany

[73] Assignee: Gebr. Eickhoff Maschinenfabrik u. Eisengieberei mbH, Fed. Rep. of Germany

[21] Appl. No.: 229,255

[22] Filed: Aug. 5, 1988

[30] Foreign Application Priority Data

Aug. 20, 1987 [DE] Fed. Rep. of Germany ..... 3727800

[51] Int. Cl.[4] ..... E21C 29/00; E21C 35/24

[52] U.S. Cl. ..... 299/30; 299/42

[58] Field of Search ..... 299/1, 30, 42, 43; 173/2, 4, 5

[56] References Cited

U.S. PATENT DOCUMENTS

| | | | |
|---|---|---|---|
| 4,367,900 | 1/1983 | Trumper | 299/30 X |
| 4,407,545 | 10/1983 | Stopanni | 299/43 X |

FOREIGN PATENT DOCUMENTS

| | | | |
|---|---|---|---|
| 1233356 | 2/1972 | Fed. Rep. of Germany . | |
| 2802303 | 7/1979 | Fed. Rep. of Germany | 299/42 |
| 3716668 | 5/1987 | Fed. Rep. of Germany . | |
| 923705 | 4/1963 | United Kingdom | 299/30 |
| 1011911 | 12/1965 | United Kingdom | 299/30 |

*Primary Examiner*—Bruce M. Kisliuk
*Assistant Examiner*—David J. Bagnell
*Attorney, Agent, or Firm*—Clifford A. Poff

[57] ABSTRACT

A power supply system for a drum-cutter mining machine utilized in longwall mining operations. Three-phase electrical power is supplied to a rectifier circuit positioned remote from the mining machine to rectify the three-phase electrical power. Rectified electrical power is supplied to the mining machine through cables, whereat the electrical power is inverted by inverters. Power transistors are coupled between the inverters and the respective motors of the mining machine. Positioning the rectifier remote from the mining machine allows the body of the mining machine to be of reduced dimensions.

9 Claims, 2 Drawing Sheets

POWER SUPPLY SYSTEM FOR AN UNDERGROUND MINING MACHINE

BACKGROUND OF THE INVENTION

1. Field of the Invention

The present invention relates generally to mining machines utilized in underground mining operations, and, more particularly, to a power supply system for supplying electrical power to individual asynchronous motors one of which supplies torque to drum-cutter and another of the drive motors supplies torque to propel the mining machine along the mine face.

2. Description of the Prior Art

Longwall mining procedures typically utilize an electrically powered drum-cutter mining machine to release coal from a mine wall face. The drum cutter loader mining machine, also sometimes referred to as a shearer loader, includes one or two circular cutting drums supported by an arm at ends of the mining machine.

In the underground mine working operation, it is typical to form in the mine work area two spaced laterals which are passageways extending from a main galley area of the mine. The laterals are typically spaced apart at a distance of several hundred feet, and the laterals are interconnected at their distal ends by a tunnel having a sidewall comprising a longwall mine face. Once the longwall mine face has been created, a longwall conveyor having a rack structure attached thereto is erected along the longwall mine face. The drum-cutter mining machine is then positioned on conveyor proximate to the longwall mine face whereat longwall mining operations may commence. Translation of the mining machine along the mine wall face is achieved by means of a geared connection between the mining machine and the rack structure.

West German Patent Application P 37 16 668.9 discloses a drum-cutter mining machine provided with a winch driven by an electric drive motor arranged at a right angle to the direction of machine travel and provides torque to rotate a drive wheel of the winch. The drive wheel engages a chain or with the teeth of the rack structure to thereby allow translation of the mining machine along the face conveyor. Reduction gearing drivenly interconnects the drive wheel with the motor. The drive motor is designed as three-phase short-circuited rotor supplied with electrical power from a frequency converter, for example, a steplessly adjustable transistor inverter.

West German Patent DE-AS 12 33 356 discloses a drum-cutter mining machine provided with two electric motors, the first of which comprises a drive motor to drive a winch for allowing translation of the mining machine, and the second of which comprises a cutting-drum motor to drive the cutting tool. The two motors receive electrical current from controllable inverters comprised of silicon cells (thysistors) supplied with three-phase alternating current by a contactor in the mine drift. The thyristors coordinated with the drift contactors located in the drift area of the mine allowing the frequency and/or output voltage of the load current supplied to the motors to be steplessly controllable. This control of speed and/or load current thereby allows the motor torque of the motors to be set at any desired value, or altered, steplessly, so that the winch and cutter drum each operate at the most favorable speed. Control lines comprising electrical cables extending to rectifiers connected to a contractor in the mine drift are necessary to allow the operator of the mining machine to control the rectifier and contactor circuits located in drift area of the mine and thereby control the cutting drum speed and speed of travel by the mining machine during mining operations in either direction of travel by the machine. In order to match the speed of travel by the mining machine with the underground mining operations, it is necessary to control the winch motor and the cutting drum motor independently of one another by coal-cutter cables which connect the drift contractor with the cutter drum motor and the winch motor.

If all the equipment required in order to control the speed of both of the motors were to be positioned within the body of the mining machine, an large increase to the dimensional size of the mining machine body would be required to accommodate such equipment. It is important, of course, to minimize the dimensions of the mining machine used in an underground mine.

It is therefore an object of the present invention to provide a space saving construction and arrangement of a drum-cutter mining machine with two independently controllable electric drive motors in a machine body of minimal dimensions.

It is a further object of the present invention to provide a drum-cutter mining machine which includes independently controllable drive motors and cutting drum motors.

It is a still further object of the present invention to provide an improved arrangement of equipment of electrical supply system for a drum-cutter mining machine which includes a rectifier circuit in a mine drift area and controllable inverters on the mining machine.

SUMMARY OF THE INVENTION

In accordance with the present invention, an electrical power supply system for an underground mining machine utilized in longwall mining operations is disclosed. The system supplies alternating current usually three-phase electrical power to electrical motors on the mining machine from an electrical power source. The system includes rectifying means positioned remote from the mining machine in the mine drift and coupled to receive the electrical power from a power source. The rectifying means converts the electrical current, e.g., three-phase alternating current to rectified, direct current power. Inverter means are positioned on the mining machine for converting the rectified, direct current to alternating current power preferably three-phase alternating current for operating at least a winch drive motor. In one embodiment, the cutting drum drive motor is supplied with alternating current by the cable from the three-phase power source. In a second embodiment, separate inverter means on the mining machine supplied with direct current are arranged to supply separately controlled alternating current to the winch drive motor and the cutting drum drive motor.

When the mining machine is provided with two winch drive motors and two cutting drum motors, the cable means is preferably comprised of a first set of cables for supplying rectified direct current power inverters on the mining machine connected to the winch drive motors, and a second set of cables supplies rectified, direct current power to other inverters on the mining machine connected the cutting drum motors. In this way, the frequency of the alternating current supplied to motors of the cutting drums and the motors of the winches can be varied to control the rotation speed of the cutting drums and the speed of travel by the mining machine.

It is advantageous to provide an individually controllable inverter for each drive motor for the cutting drums. In this way, it is possible to separately control the drive motors so that the cutting drums rotate at different speeds of rotation. This arrangement is particularly useful to cause the relevant cutting drum that is trailing with respect to the direction of travel by the mining machine to rotate at a slower speed because frequently the cutting drum operates to only clear the winning track; keep it free of debris and release coal at the coal floor while reducing the build-up of dust which is particularly acute due to the operation of this trailing cutting drum.

According to a further feature of the present invention, the cable means which extends from the drum-cutter loader mining machine to the source of alternating current remote to the mining machine takes the form of a cable having at least two groups of cores, e.g. electrical conductors. One group of cores supplies alternating electrical current from a contractor in the drift of the mine to the drive motors of the cutting drums and a second group of cores supplies rectified direct current delivered from rectifiers in the drift of the mine to inverters on the mining machine for delivering alternating current to drive motors of the winches. This current supply arrangement for drive motors is useful when, on the one hand, it is desired to control the speed of the winch motors in both directions of rotation and on the other hand, alternating current can be supplied from the network in the drift of the mine to the cutting drum motors when it is unnecessary to control the speed of the cutting drums.

BRIEF DESCRIPTION OF THE DRAWINGS

The present invention will be better understood when read in light of the accompanying drawings in which.

DESCRIPTION OF THE PREFERRED EMBODIMENTS

Figure 1:
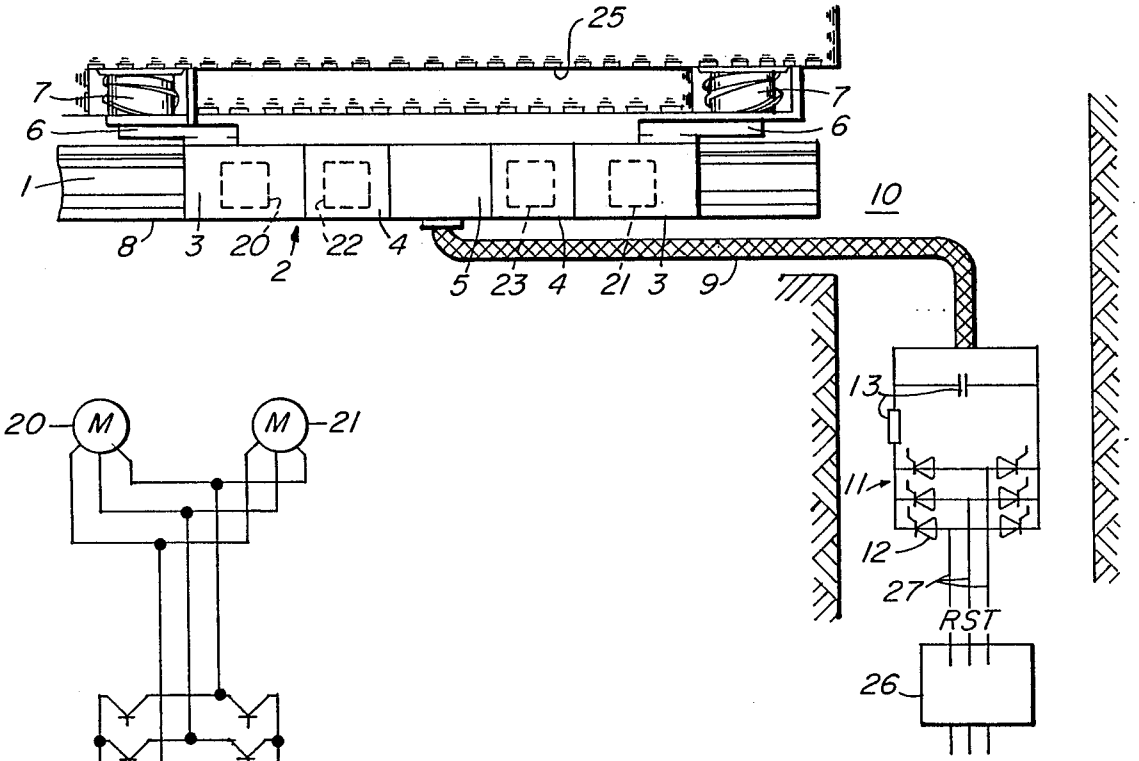
FIG. 1 is a partial block, partial plan view of the drum-cutter mining machine of the present invention.

Referring first to the partial block, partial plan view of FIG. 1, there is illustrated a longwall conveyor 1 supported on a mine floor to extend along a longwall mine wall face 25. A drum-cutter mining machine 2 of the present invention is supported for back and forth traversing movement along longwall conveyor 1. Mining machine 2 includes two cutting-drum units 3 with drive motors 20 and 21, two haulage box units 4 with drive motors 22 and 23, and energy distribution unit 5. The cutting-drum units 3 each include a pivotal support arm 6 extending therefrom and rotatably supporting a cutting drum 7 in a manner per se well known in the art. The cutting drums 7 are rotated through individual gear trains driven by individual asynchronous drive motors 20 and 21.

Drive motors 22 and 23 are asynchronous motors which are part of the haulage box units 4 that provide torque to rotate a drive wheel, which has teeth to mesh with teeth of an elongated rack assembly 8 supported along one side of the longwall conveyor 1. The rack assembly 8 is supported by the longwall conveyor to extend along the goaf-side of the longwall conveyor 1. Coal-cutter cable 9 supplies distribution unit 5 of the mining machine 2 with electrical power from a drift area 10 of the underground mine which is remote to the site of traversing movement by the mining machine 2.

Rectifier 11 is supported in the drift area 10 of the mine where it is electrically coupled to one side of contactor 26 by lines 27. Rectifier 11 contains a plurality of transistors 12 connected, in a manner well known per-se in the art, to convert the three-phase alternating current supplied by lines 27 to rectified, direct current. R-C circuit 13 having a combined resistive and capacitive characteristic equalizes the direct current and also forms a part of rectifier 11. According to the present invention, direct current power produced by rectifier 11 is delivered by cores 14 and 15 making up at least one pair of cores forming part of the coal-cutter cable 9 to the energy unit 5.

Figure 2:
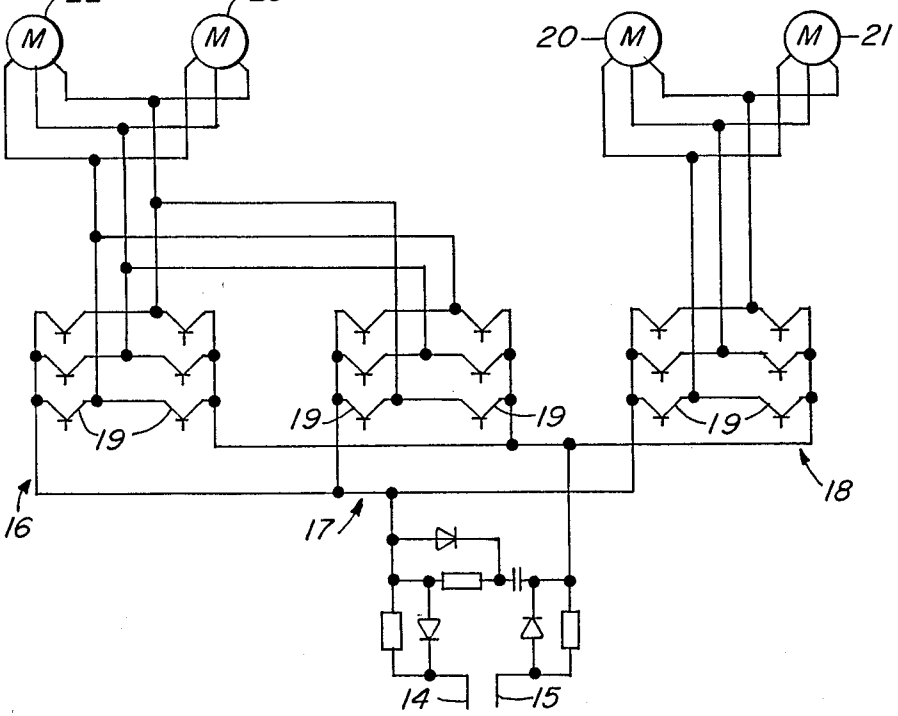
FIG. 2 is a circuit diagram according to one embodiment of the power supply system of the present invention.

Referring now to the circuit diagram of FIG. 2, in this embodiment the cores 14 and 15 are both coupled in the energy distribution unit 5 to inverters 16, 17, and 18 which include power transistors 19 that are controlled to convert the direct current power supplied thereto into alternating current power. The power transistors 19 are controlled to control the frequency of the output alternating current supplied to the motors 20–23 by lines 26.

In the embodiment of FIGS. 2, the two cutting drums 7 are driven by asynchronous driving motors 20 and 21 supplied with an alternating current of variable frequency by inverter 18 which is designed for one quadrant operation. The cutting drums 7 both rotate in a same direction of rotation at a speed that can be selectively varied.

Drive motor 22 and 23 which are also asynchronous motors are separately housed in the two haulage box units 4. In longwall mining operations, the mining machine 2 must translate in both of opposite directions along rack 8 of the longwall conveyor 1. Inverters 16 and 17 are designed for four quadrant operation of motors 22 and 23 and for rotation in either of opposite directions to fulfill the need for traversing movement of the mining machine in opposite directions. The motors 22 and 23 are supplied with alternating current of variable frequency whereby the speeds of rotation in either direction can be selectively varied by controlling the transistors 19. The desired frequency of the alternating current power is selected so that the speed of rotation can be varied by varying the frequency of the rotating field.

Because the rectifier 11 is positioned remote from the mining machine 2, the body of mining machine 2 may be of reduced dimensions. Further, the mining machine operator, who is positioned proximate to the mining machine 2, does not require separate control lines leading to the drift area as the operator may, through suitable control of the power transistors 19 inside the machine body, control the frequency of the motor currents to thereby vary the speed of motors 20–23.

Figure 3:
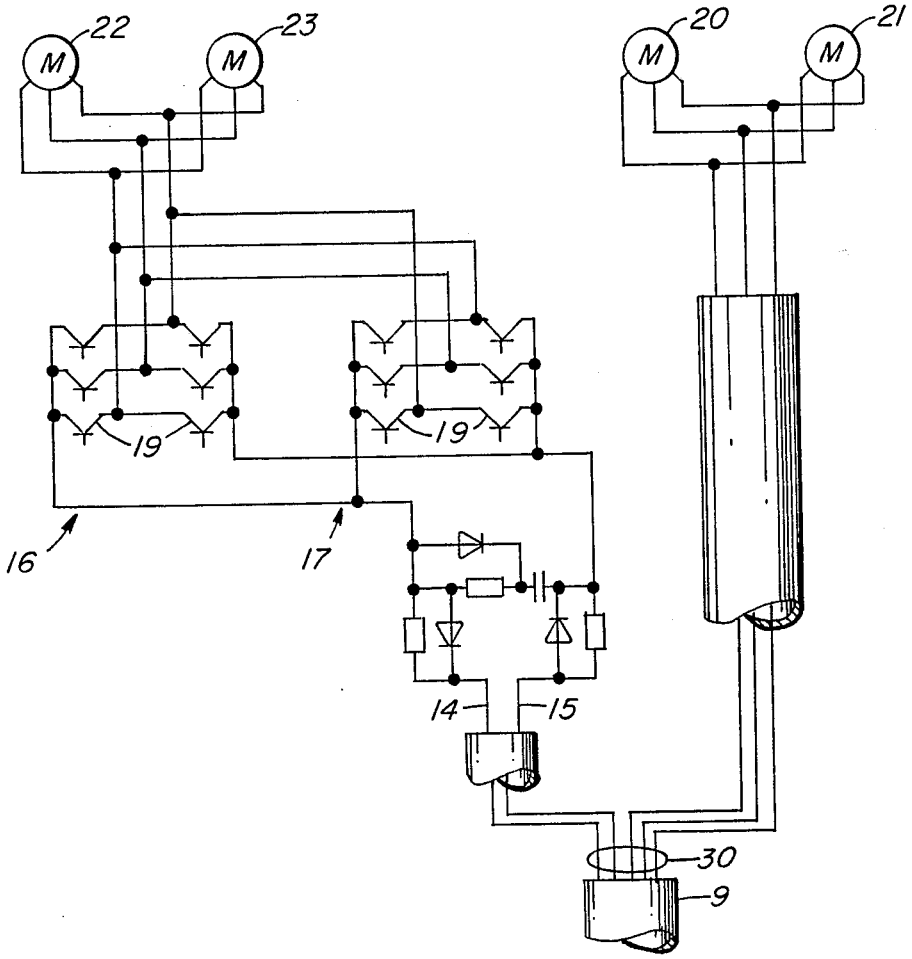
FIG. 3 is a circuit diagram according to a second embodiment of the present invention.

In FIG. 3 there is illustrated a circuit diagram according to a further embodiment of the present invention wherein in the same manner as described hereinbefore in regard to the embodiment of FIG. 2, asynchronous drive motors 22 and 23 are supplied with a selectively variable frequency of alternating current by inverters 16 and 17 which are in turn supplied with equalized direct current by cores 14 and 15 forming part of cable 9. Also as previously described, cores 14 and 15 receive equalized direct current from rectifier 11. Cable 9 further includes a core assembly 30 which is coupled directly to the contractor 26 for delivering alternating current, preferably three-phase, to the core assembly which delivers the alternating current separately to energy unit 5 for distribution to each of the drum cutter drive motors 20 and 21 as situated in the drum cutter units 3. In this embodiment, it is unnecessary to control the speed of the drum cutter drive motors for the cutting drums, on the one hand while the embodiment insures, on the other hand that the drive motors 22 and 23 for the winch drives are controlled as to their speed of rotation in both of opposite directions by operation of the inverters 16 and 17 supplied with equalized direct current by cores 14 and 15.

Figure 4:
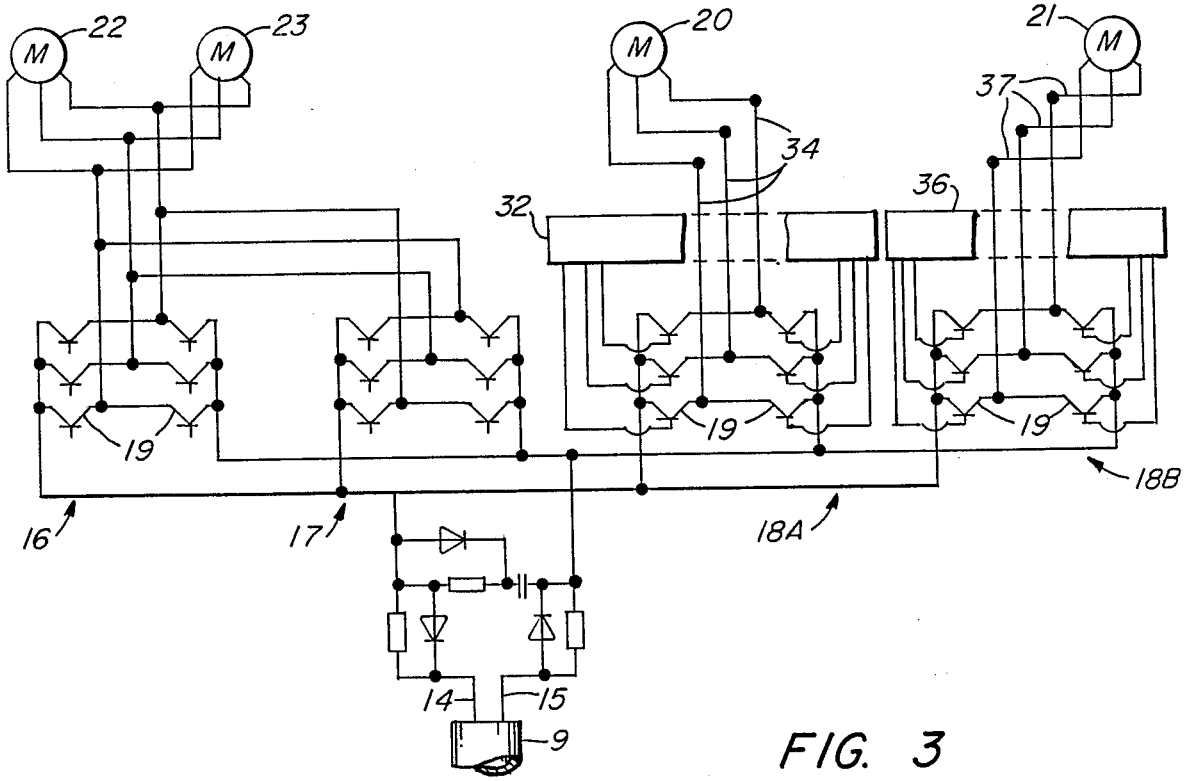
FIG. 4 is a circuit diagram according to a third embodiment of the present invention.

In FIG. 4, the schematic illustration provides that winch drive motors 22 and 23, in the same manner as discussed in the embodiment of FIG. 2, are supplied with a selective variable frequency current from inverters 16 and 17 which control not only the speed of rotation of the motors but also their direction of rotation using the equalized direct current supplied by cores 14 and 15 in cable 9. The equalized direct current in cores 14 and 15 is also applied to discrete inverters 18A and 18B which include transistors 19, typically in the form of silicon controlled rectifiers. The transistors 19 of inverter 18A are connected to a firing circuit 32 which controls the frequency of the alternating current produced by the inverter and delivered by lines 34 to asynchronous drive motor 20 for one of the cutter drums. Similarly inverter 18B includes transistors 19 that are controlled by a firing circuit 36 so that the frequency of the alternating current produced by the inverter and delivered by lines 37 to asynchronous drive motor 21. Drive motor 21 is used for rotating the drum cutter 7 of the mining machine. By this arrangement, it is possible to drive the two cutting drums at different speeds of rotation and to allow the relevant cutting drum which is trailing with respect to the direction of the machine travel to rotate at a slower speed than the leading cutting drum. Such an arrangement is particularly advantageous because frequently the trailing cutting drum is used only to clear the winning track for traversing machine travel and to assure that the track is free of debris. The trailing cutting drum in this mode of operation is utilized to release coal at the coal floor. Under these conditions, the lower rotational speed of the trailing cutting drum prevents the build-up of dust which is particularly acute at the particular site and conditions under which the trailing drum operates.

While the present invention has been described in accordance with the preferred embodiments of the various figures, it is to be understood that other similar embodiment may be used or modifications and additions may be made to the described embodiment for performing the same functions of the present invention without deviating therefrom. Therefore, the present invention should not be limited to any single embodiment but rather construed in breadth and scope in accordance with the recitation of the appended claims.

What is claimed is:

1. A drum-cutter loader for underground mining operations, the combination with said drum cutter-loader and a source of three phase electrical power including:

at least one cutting drum driven by a first asynchronous motor on the drum cutter-loader to release material from a mine face, and at least one winch driven by a second asynchronous motor on the drum cutter-loader for propelling the drum cutter-loader back and forth along the mine face, rectifying means positioned remote from the drum cutter-loader coupled to receive three-phase power from a three-phase power source for converting the three-phase power to rectified direct current power;

cable means extending to the drum-cutter loader while coupled to said rectifying means for supplying said rectified direct current power; and inverter means on the drum cutter-loader for converting the rectified direct current power supplied to said cable means to alternating current power to supply electrical power to said second asynchronous motor for driving the winch.

2. The power supply system of claim 1 wherein said second asynchronous motor positioned on the drum cutter loader includes at least one drive motor to allow translation of the mining machine.

3. The power supply system of claim 2 wherein said second asynchronous motor positioned on the drum cutter loader includes a first drive motor and a second drive motor.

4. The power supply system of claim 1 wherein said first asynchronous motor positioned on the drum cutter-loader includes at least one cutting drum motor.

5. The power supply system of claim 4 wherein said first asynchronous motor positioned on the drum cutter loader includes a first cutting drum motor and a second cutting drum motor.

6. The power supply system of claim 1 wherein said rectifying means is positioned in a drift area of an underground mine.

7. The power supply system of claim 1 wherein said cable means includes a first set of cables for supplying said rectified direct current power to said second asynchronous motor, and a second set of cables to supply said rectified direct current power to said first asynchronous motor.

8. The power supply system of claim 7 wherein said inverter means includes inverters coupled to both the first set of cables and to the second set of cables.

9. The power supply system of claim 1 further including means including power transistors for selectively interconnecting the inverter means and the first and second asynchronous motors.

* * * * *